US007735915B2

(12) United States Patent
Nye et al.

(10) Patent No.: US 7,735,915 B2
(45) Date of Patent: Jun. 15, 2010

(54) PICNIC TABLE

(75) Inventors: S. Curtis Nye, Clinton, UT (US); Stephen F. Nye, Syracuse, UT (US)

(73) Assignee: Lifetime Products, Inc., Clearfield, UT (US)

( * ) Notice: Subject to any disclaimer, the term of this patent is extended or adjusted under 35 U.S.C. 154(b) by 780 days.

(21) Appl. No.: 11/329,013

(22) Filed: Jan. 10, 2006

(65) Prior Publication Data

US 2006/0181114 A1 Aug. 17, 2006

Related U.S. Application Data

(60) Provisional application No. 60/642,611, filed on Jan. 10, 2005.

(51) Int. Cl.
*A47B 83/02* (2006.01)
*A47B 3/00* (2006.01)

(52) U.S. Cl. ..... 297/158.4; 108/132

(58) Field of Classification Search ..... 297/173, 297/157.1, 158.3, 158.4; 108/174, 169, 130, 108/127, 131–133
See application file for complete search history.

(56) References Cited

U.S. PATENT DOCUMENTS 324,320 A * 8/1885 Hanson ..... 108/36
2,470,869 A * 5/1949 Schmidt ..... 108/132
3,606,846 A * 9/1971 Andrews et al ..... 108/132
5,921,623 A * 7/1999 Nye et al. ..... 297/158.4
6,644,734 B1 * 11/2003 Tseng ..... 297/158.4
7,055,563 B2 * 6/2006 Logan ..... 144/286.5
2003/0233967 A1 * 12/2003 Lin ..... 108/129
2004/0195869 A1 * 10/2004 Zhurong et al. ..... 297/158.4
2004/0227382 A1 * 11/2004 Lin ..... 297/158.4
2004/0255829 A1 * 12/2004 Cizmar et al. ..... 108/132
2005/0103239 A1 * 5/2005 Neunzert et al. ..... 108/132

* cited by examiner

*Primary Examiner*—Milton Nelson, Jr.
(74) *Attorney, Agent, or Firm*—Workman Nydegger

(57) ABSTRACT

A picnic table may include a table top, bench tops and one or more legs or support assemblies. The support assemblies may be movable between a collapsed or storage position and an extended or use position. When the support assemblies are in the extended or use position, the support assemblies may contact or engage supports that are sized and configured to limit movement of the support assemblies. The picnic table may also include one or more positioning members, which may be sized and configured to help position, locate and/or guide various components of the picnic table. In addition, the picnic table may include one or more retaining members, which may be sized and configured to releasably receive and retain a portion of the legs and/or support assemblies when the legs or support assemblies are in the collapsed position.

21 Claims, 3 Drawing Sheets

PICNIC TABLE

CROSS-REFERENCE TO RELATED APPLICATIONS

This application claims priority to and the benefit of U.S. provisional patent application Ser. No. 60/642,611, filed Jan. 10, 2005, entitled PICNIC TABLE, the disclosure of which is incorporated by reference in its entirety.

BACKGROUND OF THE INVENTION

1. Field of the Invention

The present invention is generally related to picnic tables. More particularly, the present invention is related to picnic tables that are movable between a collapsed position and a use position.

2. Description of Related Art

Picnic tables offer the convenience of having a table and seating for the table combined into one unit. Picnic tables also offer the advantage of being able to seat a large number of people around a table. Conventional picnic tables are generally used outdoors and have become increasingly popular as more and more people spend their leisure time outside. For example, picnic tables can be found in backyards, parks, campsites and various other places. Additionally, picnic tables may be used indoors, such as to provide temporary seating in cafeterias, gymnasiums, homes and other places.

Conventional picnic tables that remain outdoors for long periods of time are subject to potentially damaging elements that could shorten the life span of the picnic table. For example, the sun, wind, rain and/or snow may damage conventional picnic tables. Thus, it is often desirable to be able to store the picnic table in a protected area such as a garage or storage shed. The temporary use of a picnic table indoors also creates a need to be able to store the table after using it. Unfortunately, most picnic tables are too bulky to store conveniently.

Known picnic tables may be movable between a use position in which the table and benches are configured to be used and a collapsed or storage position in which the picnic table is folded or moved into a smaller, more compact arrangement. For example, known picnic tables may include support legs or assemblies that are used to support the benches and table above the ground or floor when the picnic table is in the use position. The support legs or assemblies may be pivotally connected to the benches and table to allow the picnic table to be moved into the collapsed position. Disadvantageously, the support legs or assemblies of these conventional picnic tables may not be securely attached to the benches and/or table, which may allow the picnic table to fail. In addition, these known picnic tables may be difficult and awkward to move between the use and storage positions. Further, these picnic tables that are movable between use and storage positions may be more expensive to manufacture because they often require additional parts and labor to manufacture the picnic table.

BRIEF SUMMARY OF EMBODIMENTS OF THE INVENTION

A need therefore exists for a picnic table that eliminates or diminishes the disadvantages and problems described above.

One aspect is a picnic table that may include a table and two benches that are disposed proximate the sides of the table. The picnic table may also include one or more support assemblies that are connected to a table top of the table and bench tops of the benches. For example, the picnic table may include a first support assembly and a second support assembly, and the support assemblies may have a generally U-shaped configuration. The ends of the generally U-shaped support assemblies may be connected to the bench tops. The picnic table may also include one or more support members disposed proximate the center portion of the support assemblies. The support members may connect the table top to the support assemblies. The support members may be adjustable in height to allow the height of the table top to be adjusted.

Another aspect is a picnic table that may be movable between collapsed and extended positions. For example, the picnic table may include a use position in which the support assemblies support the bench tops and the table top above a surface such as the ground or floor. The picnic table may also include a collapsed position in which the support assemblies are disposed near or adjacent to the bench tops and/or the table top to allow, for example, the picnic table to be more easily moved and/or stored.

Yet another aspect is a picnic table that may include support assemblies that are pivotally attached to the bench tops to allow the picnic table to be moved between the use and the collapsed positions. For example, a support assembly may be connected to a cross member that is attached to the bench tops. The cross member preferably can pivot or rotate relative to the bench top to allow the support assembly to move relative to the bench top. A support may be disposed proximate the cross member and the support may help strengthen the cross member and/or the bench top. The support is preferably sized, configured and positioned so that as the support assembly is moved from the collapsed position to the use position, the support assembly contacts, abuts and/or engages the support to prevent further rotation of the support assembly relative to the bench top. Significantly, this may help position the support assembly in the correct location. In addition, this may make the picnic table easier to move between the collapsed and use positions.

Still another aspect is a picnic table that may include a support brace connected to the support assemblies. For example, the picnic table may include a support brace with one end connected to a support assembly and the other end connected to the table top. In particular, the end of the brace may be connected to a cross member or bar that is connected to the table top. Advantageously, the brace may be pivotally attached to the cross member. For instance, the end of the brace may include an opening and the cross member may be disposed within the opening to allow the brace to pivot relative to the cross member. This may allow the cross member to be securely attached to the table top and the brace does not have to be welded or otherwise fixed to the cross member. Significantly, this may help reduce manufacturing costs and may reduce manufacturing defects.

A further aspect is a picnic table that may include a table top with one or more protrusions, extensions or the like. For example, the picnic table may include protrusions that extend downwardly from the lower portion of the table top. The protrusions may be sized and configured to help position or locate various components. For instance, the protrusions may be positioned to help locate a cross member that extends across at least a portion of the table. The protrusions may also be positioned to help locate the connection of a brace to the cross member. Advantageously, the protrusions may help maintain the correct positioning of the brace relative to the cross member.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

Figure 1:
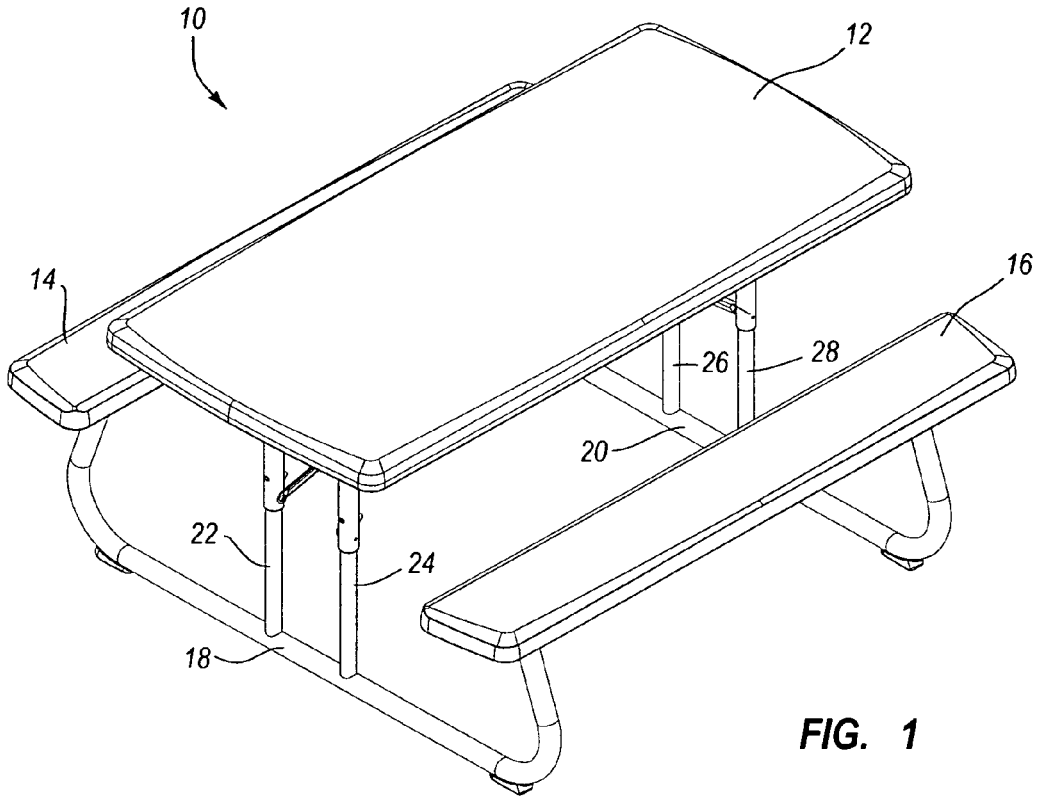
FIG. 1 is a top perspective view of an exemplary picnic table.

The present invention is directed towards a picnic table. The principles of the present invention, however, are not limited to a picnic table. It will be understood that, in light of the present disclosure, the various aspects of the picnic table disclosed herein can be successfully used in connection with other types of furniture.

Additionally, to assist in the description of the picnic table, words such as top, bottom, front, rear, right and left are used to describe the accompanying figures. It will be appreciated, however, that the picnic table can be located in a variety of desired positions—including various angles, sideways and even upside down. A detailed description of the picnic table now follows.

As shown in FIGS. 1-6, an exemplary embodiment of a picnic table 10 includes a table top 12, a first bench top 14 and a second bench top 16. The picnic table 10 may also include one or more legs or support assemblies that are sized and configured to support the table top 12 and bench tops 14, 16 in the desired positions. For example, the picnic table 10 may include a first support assembly 18 and a second support assembly 20. The support assemblies 18, 20 may have a generally U-shaped configuration and the ends of the support assemblies may be connected to the first and second bench tops 14, 16.

One or more support members may be used to connect the table top 12 to the first and second support assemblies 18, 20. For example, as shown in the accompanying figures, the picnic table 10 may include four support members 22, 24, 26, 28 that interconnect the support assemblies 18, 20 and the table top 12. The support members 22, 24, 26, 28 are preferably disposed proximate a center portion of the support assemblies 18, 20 and the support members are preferably adjustable in height to allow the height of the table top 12 to be adjusted. It will be appreciated that the support assemblies 18, 20 and the support members 22, 24, 26, 28 may have a variety of other suitable sizes, shapes and configurations. It will also be appreciated that the picnic table 10 may have other appropriate types and numbers of supports, legs and the like depending, for example, upon the intended use or design of the picnic table.

The picnic table 10 is preferably movable between a use or extended position and a collapsed or storage position. In the use position, the support assemblies 18, 20 and the support members 22, 24, 26, 28 may support the table top 12 and the bench tops 14, 16 above a surface such as the ground or floor. In the collapsed position, the support assemblies 18, 20 and the support members 22, 24, 26, 28 are preferably disposed proximate to the table top 12 and/or the bench tops 14, 16 to allow, for example, the picnic table to be more easily moved and/or stored.

The support members 22, 24, 26, 28 may be movably attached to the table top 12 to help allow the picnic table 10 to be moved between collapsed and extended positions. For example, the support members 22, 24 may be connected to a cross member 30 that is connected to the table top 12 and the support members 26, 28 may be connected to a cross member 32 that is connected to the table top 12. The cross members 30, 32 may be movable relative to the table top 12 to allow the support members 22, 24, 26, 28 to move relative to the table top. For instance, the cross members 30, 32 may be pivotally connected to a table frame, which may include a pair of side rails 34, 36, and the cross members may allow the support members 22, 24, 26, 28 to pivot relative to the table top 12. The support members 22, 24, 26, 28 may also be connected to the table top 12 in other suitable configurations and manners. For example, the support members 22, 24, 26, 28 may be pivotally connected to the cross members 30, 32, if desired.

The support assemblies 18, 20 may also be movably attached to the bench tops 14, 16 to help allow the picnic table 10 to be moved between collapsed and extended positions. For example, if the support assemblies 18, 20 have a generally U-shaped configuration, then the ends of the support assemblies may be connected to cross members that are connected to the bench tops 14, 16. For example, the support assembly 18 may be connected to a first cross member 38 that is connected to the bench top 14 and a second cross member 40 that is connected to the bench top 16. In addition, the support assembly 20 may be connected to a first cross member 42 that is connected to the bench top 14 and a second cross member 44 that is connected to the bench top 16. The cross members 38, 40, 42, 44 may be movable relative to the bench tops 14, 16 to allow the support assemblies 18, 20 to move relative to the bench tops. In particular, the cross members 38, 42 may be movably connected to the bench top 14 by a pair of side rails 46, 48. Additionally, the cross members 40, 44 may be movably connected to the bench top 16 by a pair of side rails 50, 52. The cross members 38, 40, 42, 44 may be pivotally connected to the bench tops 14, 16. The support assemblies 18, 20 may also be pivotally connected to the cross members 38, 40, 42, 44, if desired. It will be appreciated that the support assemblies 18, 20 and the bench tops 14, 16 may be connected in other suitable configurations and arrangements.

Figure 2:
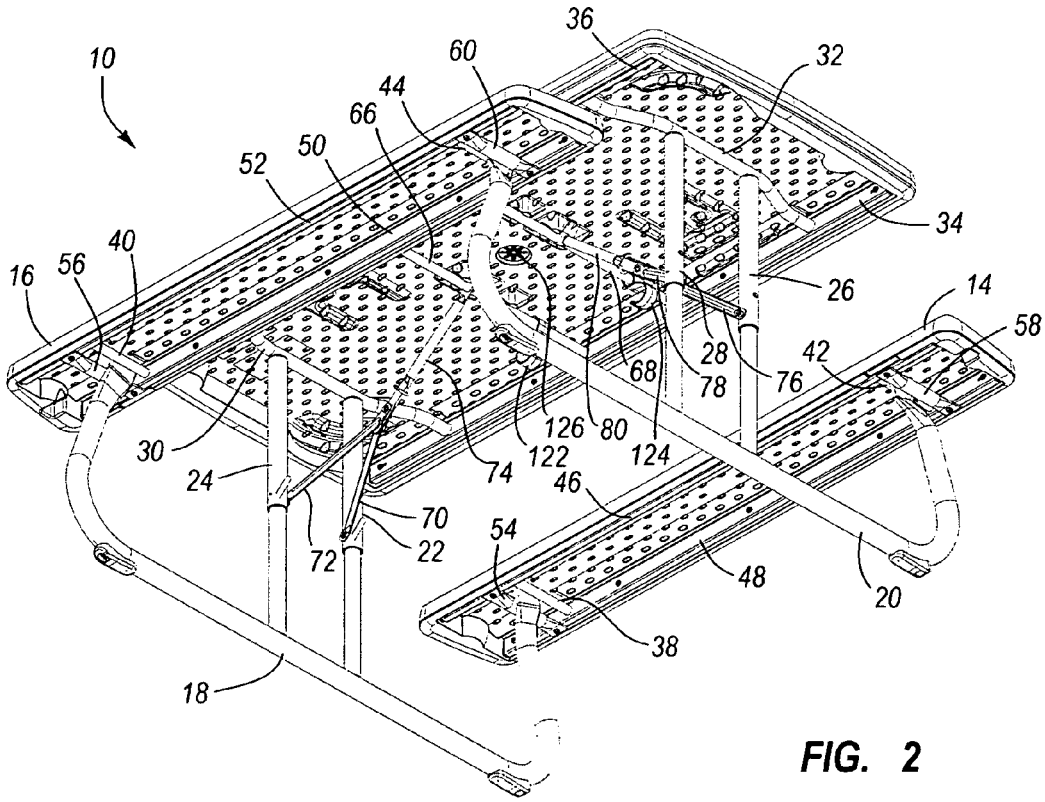
FIG. 2 is a bottom perspective view of the picnic table shown in FIG. 1.
Figure 3:
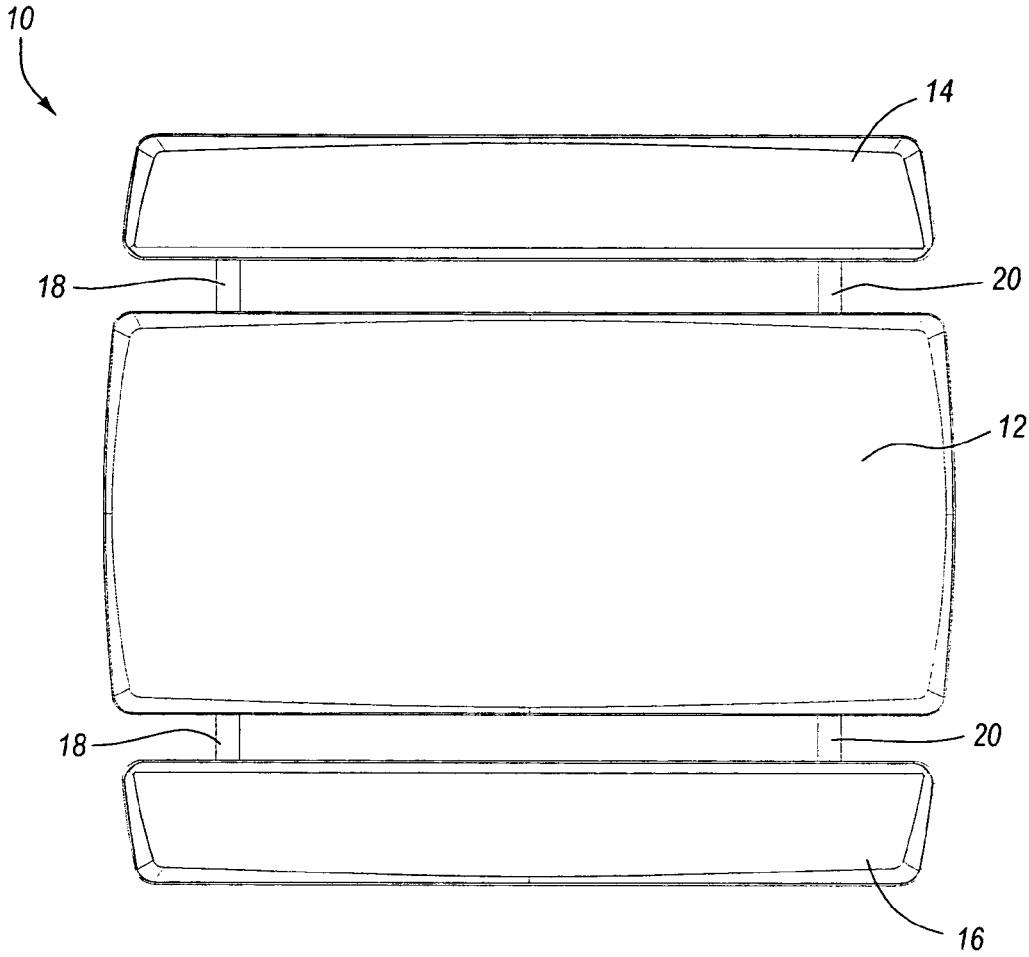
FIG. 3 is a top view of the picnic table shown in FIG. 1.
Figure 4:
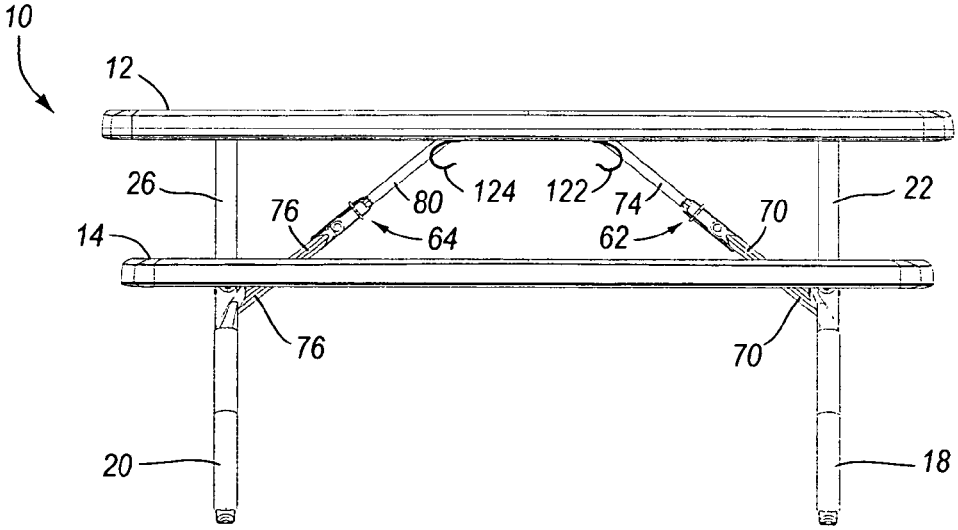
FIG. 4 is a front view of the picnic table shown in FIG. 1.
Figure 5:
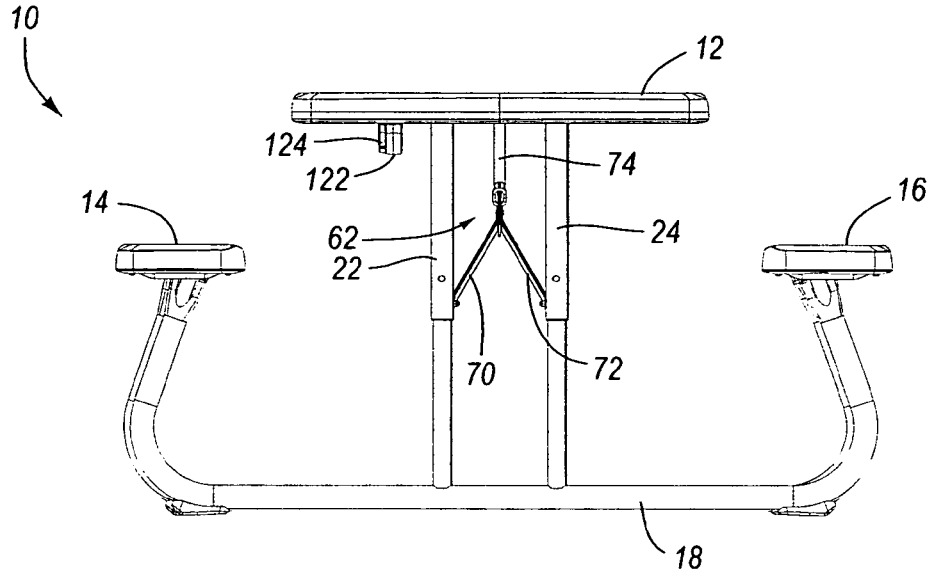
FIG. 5 is a side view of the picnic table shown in FIG. 1.

As shown in FIG. 2, the picnic table may include supports 54, 56, 58, 60, which may be disposed proximate the cross members 38, 40, 42, 44, respectively. The supports 54, 56, 58, 60 may advantageously help strengthen the cross members 38, 40, 42, 44 and/or the bench tops 14, 16. In addition, the supports 54, 56, 58, 60 may help position the picnic table 10 in the use and/or collapsed positions. Further, the supports 54, 56, 58, 60 may help create a strong and sturdy picnic table 10, and the supports may help prevent the picnic table from being damaged. For example, the supports 54, 56, 58, 60 may be sized and positioned so that, as the support assemblies 18, 20 are moved from the collapsed position to the use position, the support assemblies contact, abut and/or engage the supports to prevent further pivoting, movement or rotation of the support assemblies relative to the bench tops 14, 16. Significantly, this may limit the movement of the support assemblies 18, 20 relative to the bench tops 14, 16. This may also help position the support assemblies 18, 20 in the desired locations when the picnic table 10 is in the use position. Additionally, this may help prevent over rotation of the support assemblies 18, 20 relative to the bench tops 14, 16 and it may help secure the support assemblies in the use position. Further, this may make the picnic table 10 easier to move between the collapsed and use positions because, for example, it may be clear to the user when the support assemblies 18, 20 are in the use position.

The picnic table 10 may also include flanges that are attached to the support assemblies 18, 20 and are sized and configured to contact, abut and/or engage the bench tops 14, 16. For example, the flanges may be sized and configured to engage the side rails 46, 48, 50, 52 of the bench tops 14, 16, which may prevent further pivoting, movement or rotation of the support assemblies 18, 20 relative to the bench tops; limit the movement of the support assemblies relative to the bench tops; position the support assemblies in the desired locations when the picnic table 10 is in the use position; prevent over rotation of the support assemblies relative to the bench tops; secure the support assemblies in the use position; and make the picnic table easier to move between the collapsed and use positions.

The supports 54, 56, 58, 60 may be connected to the side rails 46, 48, 50, 52, respectively, using one or more fasteners (such as, a bolt, a screw, a rivet, and the like). The supports 54, 56, 58, 60 could also be connected to the side rails 46, 48, 50, 52 by welding, adhesives and the like. If desired, the supports 54, 56, 58, 60 may also be at least partially disposed within openings in the side rails 46, 48, 50, 52 to help connect the supports to the side rails. Advantageously, the supports 54, 56, 58, 60 may be sized and configured to be quickly and easily connected and/or disconnected, if desired. One of ordinary skill in the art will appreciate that the supports 54, 56, 58, 60 may also be connected to other suitable portions of the picnic table 10.

The picnic table 10 may include one or more support braces that are connected to the support assemblies 18, 20 and/or the support members 22, 24, 26, 28. For example, picnic table 10 may include a first support brace 62 connected to the support members 22, 24 and the table top 12. The picnic table 10 may also include a second support brace 64 connected to the support members 26, 28 and the table top 12. For example, the first support brace 62 may be connected to the table top 12 by a cross member 66 and the second support brace 62 may be connected to the table top by a cross member 68. The cross members 66, 68 may be connected to the side rails 34, 36 and the side rails may be connected to table top 12 to connect the cross members to the table top. It will be appreciated, however, that the support braces 62, 64 and/or the cross members 66, 68 may be connected to table top 12 in other suitable configurations and arrangements. It will be further appreciated that the support braces 62, 64 may be connected to the same cross member, if desired, and the cross members may have other appropriate shapes, sizes and configurations depending, for example, if the cross members extend completely across the width of the table top 12 or across only a portion of the table top.

The support braces 62, 64 preferably include a generally Y-shaped configuration. For example, the support brace 62 may include a first portion 70, a second portion 72, and a third portion 74. The first and second portions 70, 72 may be connected to the third portion 74 to form the generally Y-shaped configuration. The first and second portions 70, 72 may be connected to the support members 22, 24 and the third portion 74 may be connected to the cross member 66. Preferably, the first, second and third portions 70, 72, 74 are pivotally connected to allow the support brace 62 to move between a collapsed position and an extended position. Similarly, the support brace 64 may include a first portion 76, a second portion 78, and a third portion 80 that are pivotally connected in a generally Y-shaped configuration. It will be appreciated that the support braces 62, 64 do not require a generally Y-shaped configuration and that the support braces may have other suitable components, configurations and the like.

The support braces 62, 64 are preferably pivotally connected to the table top 12 and the support members 22, 24, 26, 28. For example, to pivotally connect the support braces 62, 64 to the table top 12, the cross members 66, 68 may be pivotally connected to the third portions 74, 80 of the support braces. In particular, the cross members 66, 68 may be inserted through openings in the third portions 74, 80 of the support braces 62, 64 to pivotally connect the support braces to the table top. One skilled in the art will appreciated that the support braces 62, 64 do not have to be pivotally connected to the table top 12 and/or the support members 22, 24, 26, 28, and the support braces may be connected to the picnic table 10 using other suitable configurations, arrangements and the like.

Figure 6:
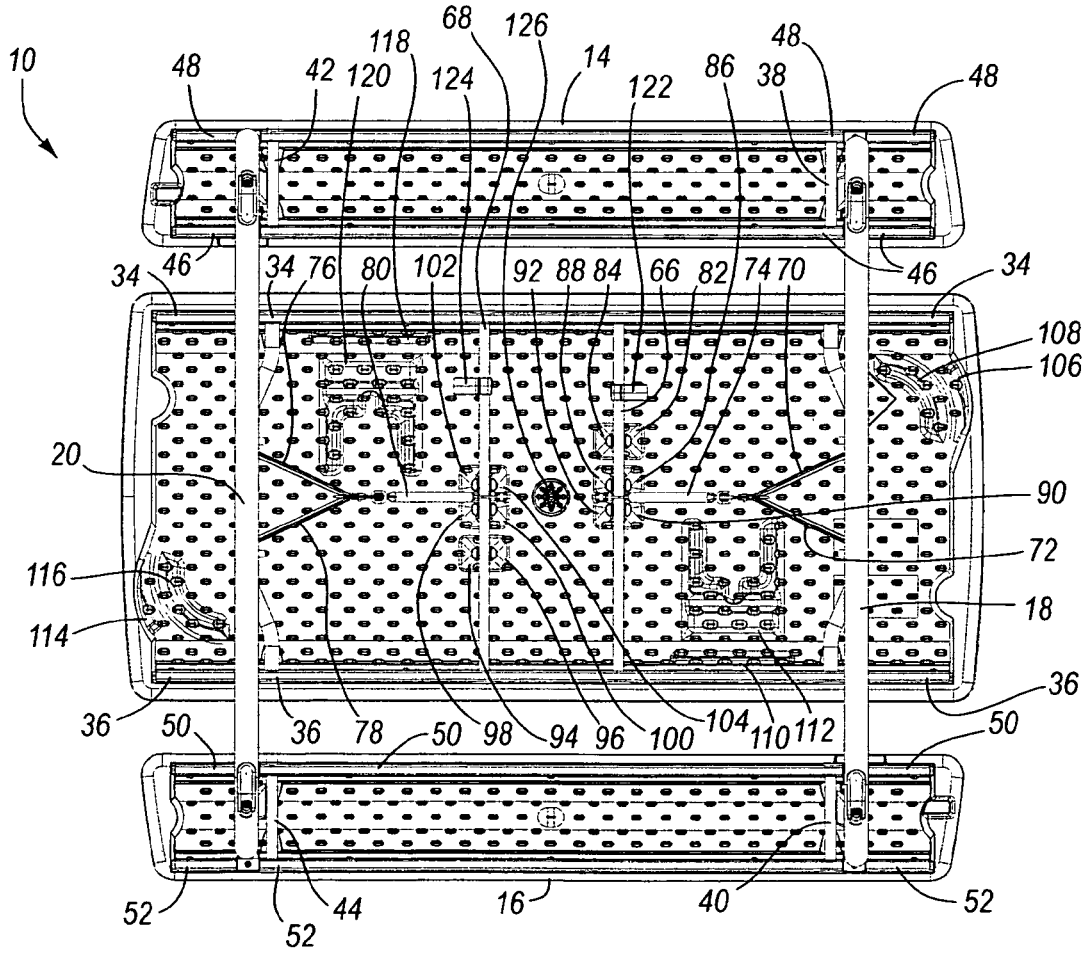
FIG. 6 is a bottom view of the picnic table shown in FIG. 1.

The picnic table 10 may include one or more positioning members, such as protrusions or extensions, which are sized and configured to help position, locate and/or guide various components. For example, as best seen in FIG. 6, the picnic table 10 may include positioning members 82, 84, 86, 88, 90, 92, 94, 96, 98, 100, 102, 104, 106, 108, 110, 112, 114, 116, 118, 120 that extend downwardly from a lower surface of the table top 12. Preferably, the positioning members 82, 84, 86, 88, 90, 92, 94, 96, 98, 100, 102, 104, 106, 108, 110, 112, 114, 116, 118, 120 are integrally formed in the table top 12 as part of a unitary, one-piece structure. For instance, if the table top 12 is constructed from blow-molded or injection molded plastic, then the positioning members are preferably integrally formed in the table top as part of the unitary, one-piece structure. It will be appreciated, however, that the positioning members and the table top may be separately formed and that the protrusions may be connected to the table top using fasteners, adhesives, a snap fit, a friction fit, an interference fit and the like. It will be understood that the picnic table 10 may include any suitable number, configuration, arrangement, etc. of the positioning members 82, 84, 86, 88, 90, 92, 94, 96, 98, 100, 102, 104, 106, 108, 110, 112, 114, 116, 118, 120, depending, for example, upon the size, configuration and/or intended use of the picnic table.

As shown in FIG. 6, the positioning members 82, 84, 86, 88, 90, 92, 94, 96, 98, 100, 102, 104 may be positioned to help position, locate and/or guide the cross members 66, 68, which may extend across at least a portion of the table top 12. The positioning members 82, 84, 86, 88, 90, 92, 94, 96, 98, 100, 102, 104 may help resist movement or deflection of the cross members 66, 68, for example, when the support assemblies 18, 20 and/or the support members 22, 24, 26, 28 are moved between the collapsed and use positions. In greater detail, when the support assemblies 18, 20 and/or the support members 22, 24, 26, 28 are moved between the collapsed and use positions, a force may be exerted on the braces 62, 64 and/or the cross members 66, 68, which may cause the cross members to deflect or bend. The positioning members 82, 84, 86, 88, 90, 92, 94, 96, 98, 100, 102, 104, however, may help to prevent or limit this deflection or bending of the cross members 66, 68.

In further detail, the positioning members 82, 86, 90 may be spaced apart from the positioning members 84, 88, 92, respectively; and the positioning members 94, 98, 102 may be spaced apart from the positioning members 96, 100, 104, respectively. Advantageously, a receiving portion may be formed between the spaced apart portions of the positioning members and the receiving portion may be sized and configured to receive and/or retain a portion of a cross member, such as the cross members 66, 68. If desired, a receiving portion may be sized and configured to receive and/or retain a portion of a cross member using a snap fit, a friction fit and/or an interference fit. In addition, a receiving portion may be sized and configured to help position, locate and/or guide the cross members 66, 68.

The positioning members 86, 88, 90, 92, 98, 100, 102, 104 may also be positioned to help locate the connection of the braces 62, 64 to the cross members 66, 68. In addition, the positioning members 86, 88, 90, 92, 98, 100, 102, 104 may be sized and configured to help maintain the braces 62, 64 in the desired position relative to the cross members 66, 68 and/or relative to the table top 12. In greater detail, when the support assemblies 18, 20 and/or the support members 22, 24, 26, 28 are moved between the collapsed and use positions, a force may be exerted on the braces 62, 64, which may cause the braces and/or the cross members to undesirably move. The positioning members 86, 88, 90, 92, 98, 100, 102, 104, however, may help to prevent or limit such movement of the braces 62, 64 and/or cross members. For example, the support braces 62, 64 may be moved between a collapsed position and a use position as the support assemblies 18, 20 and/or the support members 22, 24, 26, 28 between a collapsed position and a use position. Unfortunately, when the support assemblies 18, 20 and/or the support members 22, 24, 26, 28 are moved between the collapsed and use positions, a force may cause the portions 74, 80 of the braces 62, 64 to move laterally to a position in which additional stress is exerted on the braces as the braces are collapsed and extended. This additional stress may adversely affect the ability of the braces 62, 64 to smoothly collapse and extend and may damage the braces over a period of time. Advantageously, when the braces are collapsed and extended, the positioning members 86, 88, 90, 92, 98, 100, 102, 104 may be positioned sufficiently proximate the portions 74, 80 to prevent or limit the lateral movement of the portions by contacting the portions as a force attempts to move the portions laterally. By preventing or limiting the lateral movement of the portions 74, 80, the positioning members 86, 88, 90, 92, 98, 100, 102, 104 may advantageously help the braces 62, 64 more smoothly collapse and extend and may help avoid damage to the braces.

In further detail, the positioning members 86, 88 may be spaced apart from the positioning members 90, 92, respectively; and the positioning members 98, 100 may be spaced apart from the positioning members 102, 104, respectively. Advantageously, a receiving portion may be formed between the spaced apart portions of the protrusions and the receiving portion may be sized and configured to receive and/or retain a portion of the braces 62, 64. If desired, the receiving portion may be sized and configured to receive and/or retain the portion of a brace using a snap fit, a friction fit and/or an interference fit. In addition, a receiving portion may be sized and configured to help position, locate and/or guide the braces 62, 64.

The positioning members 106, 108, 110, 112, 114, 116, 118, 120 may be positioned to help position, locate and/or guide the support assemblies 18, 20. Preferably, the protrusions 106, 108, 110, 112, 114, 116, 118, 120 help resist the movement of the support assemblies 18, 20 when the support assemblies are in the collapsed or shipping arrangement. In greater detail, when the support assemblies 18, 20 are in the shipping arrangement, the support assemblies are preferably not connected to the table top 12 and the bench tops 14, 16 and the support assemblies preferably abut, contact and/or engage a lower surface of the table top 12 to help provide a relatively compact arrangement. During shipment, the support assemblies 18, 20 may undesirably move away from this desired shipping arrangement. The positioning members 82, 84, 86, 88, 90, 92, 94, 96, 98, 100, 102, 104, however, may help to prevent or limit this movement of the support assemblies 18, 20 relative to the table top 12.

In further detail, the positioning members 106, 110, 114, 118 may be spaced apart from the positioning members 108, 112, 116, 120, respectively. Advantageously, a receiving portion may be formed between the spaced apart portions of the positioning members and the receiving portion may be sized and configured to receive and/or retain a portion of the support assemblies 18, 20. If desired, a receiving portion may be sized and configured to receive and/or retain a portion of a support assembly using a snap fit, a friction fit and/or an interference fit. In addition, a receiving portion may be sized and configured to help position, locate and/or guide the support assemblies 18, 20.

As shown in FIGS. 2 and 4-6, the picnic table 10 may include one or more retaining members 122, 124. The retaining member 122 is preferably sized and configured to releasably receive and retain at least a portion of the support assembly 18 when the support assembly is in a collapsed position, and the retaining member 124 is preferably sized and configured to releasably receive and retain at least a portion of the support assembly 20 when the support assembly is in a collapsed position.

The retaining members 122, 124 may be connected to the cross members 66, 68, respectively. For example, the retaining members 122, 124 may each include a body portion that forms a passage through which a portion of the cross members 66, 68 may be inserted to slidably or otherwise movably connect the retaining members to the cross members. Advantageously, connection to the cross members 66, 68 may allow the retaining members 122, 124 to be quickly and easily connected to and disconnected from the cross members 66, 68. For example, if the retaining members 122, 124 were damaged and needed replacement, a retail purchaser could quickly and easily replace the retaining members. In addition, connection to the cross members 66, 68 may allow the retaining members 122, 124 to exert a force directly against the cross members, rather than directly against the table top 12, when the support assemblies 18, 20 are moved from a collapsed position towards an extended position. It will be appreciated that the retaining members 122, 124 may have other suitable configurations and may be connected to the cross members 66, 68 using any other suitable means. It will also be appreciated the retaining members 122, 124 need not be connected to the cross members 66, 68 and that the retaining members may be connected to the table top 12 and/or other portions of the picnic table 10. It will be further appreciated that the retaining members 122, 124 may be connected to the same cross member, if desired.

The positioning members 82, 84, 86, 88, 94, 96, 98, 100 may also be positioned to help position, locate and/or guide the retaining members 122, 124. For example, the retaining member 122 may be slidably or otherwise movably connected to the cross member 66 in a position that is between the positioning members 82, 86 and between the positioning members 84, 88; and the retaining member 124 may be slidably or otherwise movably connected to the cross member 68 in a position that is between the positioning members 94, 98 and between the positioning members 96, 100. Desirably, the positioning members 82, 84, 86, 88, 94, 96, 98, 100 may help restrict the movement of the retaining members 122, 124 relative to the cross members 66, 68.

As shown in FIGS. 2 and 6, the picnic table 10 may include a recessed portion 126. The recessed portion 126 may be removed to form an opening in the table top 12 through which a post may be inserted. The post may help support, for example, an umbrella. The recessed portion may be integrally formed in the table top 12, for example, during a blow-molding process. In particular, the table top 12 may include an upper wall and a lower wall, and a portion of the upper wall and a portion of the lower wall may be blow-molded to abut, contact and/or engage each other in order to form the recessed portion 126. Advantageously, the portions of the upper and lower wall that abut, contact and/or engage may be removed to form an opening through which a post may be inserted.

The table top 12 and the bench tops 14, 16 may be constructed from plastic, such as high density polyethylene. Advantageously, the plastic may allow a table top and bench tops with increased strength and rigidity to be constructed. The plastic may also allow a strong, sturdy and weather resistant table top and bench tops to be created. The table top 12 and the bench tops 14, 16 may be constructed from blow-molded plastic, but other processes such as injection molding, rotary molding, compression molding and the like may also be used to construct the table top and bench tops. The table top 12 and the bench tops 14, 16 may also be constructed from other materials and processes with suitable characteristics.

Advantageously, if the table top 12 and the bench tops 14, 16 are constructed from blow-molded plastic, the table top and the bench tops may be rigid, high-strength and capable of withstanding repeated use and wear. The blow-molded plastic table top and bench tops may also be easily manufactured and formed into the desired size and shape. In addition, the blow-molded plastic table top and the bench tops may be strong and lightweight because the table top and the bench tops may include two opposing walls that are spaced apart by a relatively small and generally constant distance. In addition, the blow-molded plastic table top and the bench tops may be lightweight because the table top and the bench tops may include a hollow interior portion, which may be formed during the blow-molding process. The blow-molded plastic table top and the bench tops may also include one or more depressions or tack-offs that may interconnect the opposing walls and these depressions may further increase the strength of the table top and the bench tops.

Significantly, the table top 12 and/or the bench tops 14, 16 may include one or more features (such as the positioning members 82, 84, 86, 88, 90, 92, 94, 96, 98, 100, 102, 104, 106, 108, 110, 112, 114, 116, 118, 120; the recessed portion 126; and/or the depressions) that are formed during the manufacturing process. In particular, these features may be integrally formed in the table top and/or the bench tops as part of a unitary, one-piece structure during the manufacturing process. For example, if the table top is constructed from blow-molded molded plastic, then one or more of these features may be formed during the blow-molding process. In addition, features as the positioning members 82, 84, 86, 88, 90, 92, 94, 96, 98, 100, 102, 104, 106, 108, 110, 112, 114, 116, 118, 120 may include a hollow interior portion that is formed during the blow-molding process. It will be appreciated that these features do not have to be formed during the manufacturing process and these features do not have to be integrally formed with the picnic table 10.

Various components of the picnic table 10 (such as the support assemblies 18, 20; the support members 22, 24, 26, 28; the cross members 30, 32, 38, 40, 42, 44, 66, 68; the side rails 34, 36, 46, 48, 50, 52; the supports 54, 56, 58, 60; and/or the braces 62, 64) may be constructed from metal, such as steel. Advantageously, the steel components may be strong and durable. It will be appreciated, however, that the support assemblies 18, 20; the support members 22, 24, 26, 28; the cross members 30, 32, 38, 40, 42, 44, 66, 68; the side rails 34, 36, 46, 48, 50, 52; the supports 54, 56, 58, 60; and/or the braces 62, 64 may also be constructed from other materials with suitable characteristics.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A picnic table comprising:

a table top;

a first bench top;

a second bench top;

a first leg assembly connected to the first bench top and the second bench top, the first leg assembly being movable between a collapsed position and an extended position;

a second leg assembly connected to the first bench top and the second bench top, the second leg assembly being movable between a collapsed position and an extended position;

a first support connected to the first bench top, the first support being sized and configured to limit movement of the first leg assembly when the first leg assembly is in the extended position, the first support having a length generally equal to a width of the first bench top and the first support being disposed generally perpendicular to a length of the first bench top;

a second support connected to the second bench top, the second support being sized and configured to limit movement of the second leg assembly when the second leg assembly is in the extended position, the second support having a length generally equal to a width of the second bench top and the second support being disposed generally perpendicular to a length of the second bench top;

a first leg connected to the first leg assembly;

a second leg connected to the first leg assembly;

a first cross member connected to the table top;

a first support brace connected to the first and second legs and the first cross member, the first support brace being movable between a collapsed position and an extended position;

a first protrusion extending from a lower surface of the table top, the first protrusion including an engagement surface that engages the first support brace to prevent lateral movement of the support brace relative to the first cross member, the first protrusion being integrally formed with the table top as part of a unitary, one-piece structure;

a second protrusion extending from the lower surface of the table top, the second protrusion including an engagement surface that engages the first support brace to prevent lateral movement of the support brace relative to the first cross member, the second protrusion being integrally formed with the table top as part of a unitary, one-piece structure.

2. The picnic table as in claim 1, wherein the first leg assembly engages the first support when the first leg assembly is in the extended position; and wherein the second leg assembly engages the second support when the second leg assembly is in the extended position.

3. A table comprising:

a table top;

a first leg connected to the table top, the first leg being movable between a collapsed position and an extended position;

a second leg connected to the table top, the second leg being movable between a collapsed position and an extended position;

a first cross member connected to the table top;

a first support brace connected to the first and second legs and the first cross member, the first support brace being movable between a collapsed position and an extended position;

a first protrusion extending from a lower surface of the table top, the first protrusion including an engagement surface that engages the first support brace to prevent lateral movement of the support brace relative to the first cross member, the first protrusion being integrally formed with the table top as part of a unitary, one-piece structure;

a second protrusion extending from the lower surface of the table top, the second protrusion including an engagement surface that engages the first support brace to prevent lateral movement of the support brace relative to the first cross member, the second protrusion being integrally formed with the table top as part of a unitary, one-piece structure; and a retaining member connected to the first cross member, the retaining member being separate and distinct from the table top, the retaining member being sized and configured to releasably receive and retain a portion of the first leg when the first leg is in the collapsed position.

4. The table as in claim 3, wherein the first protrusion includes a hollow interior portion.

5. The table as in claim 3, further comprising:

a third leg connected to the table top, the third leg being movable between a collapsed position and an extended position;

a fourth leg connected to the table top, the fourth leg being movable between a collapsed position and an extended position;

a second cross member connected to the table top;

a second support brace connected to the third and fourth legs and the second cross member, the second support brace being movable between a collapsed position and an extended position;

a third protrusion extending from a lower surface of the table top, the third protrusion including an engagement surface that engages the second support brace to prevent lateral movement of the second support brace relative to the second cross member, the third protrusion being integrally formed with the table top as part of a unitary, one-piece structure; and a fourth protrusion extending from the lower surface of the table top, the fourth protrusion including an engagement surface that engages the second support brace to prevent lateral movement of the second support brace relative to the second cross member, the fourth protrusion being integrally formed with the table top as part of a unitary, one-piece structure.

6. The table as in claim 5, further comprising:

a first bench top;

a second bench top;

a first leg assembly connected to the first and second bench tops and the first and second legs, the first leg assembly being movable between a collapsed position and an extended position; and a second leg assembly connected to the first and second bench tops and the third and fourth legs, the second leg assembly being movable between a collapsed position and an extended position.

7. A picnic table comprising:

a table top;

a first bench top;

a second bench top;

a first leg assembly connected to the first bench top and the second bench top, the first leg assembly being movable between a collapsed position and an extended position;

a second leg assembly connected to the first bench top and the second bench top, the second leg assembly being movable between a collapsed position and an extended position;

a first support connected to the first bench top, the first support being sized and configured to limit movement of the first leg assembly when the first leg assembly is in the extended position;

a second support connected to the second bench top, the second support being sized and configured to limit movement of the second leg assembly when the second leg assembly is in the extended position;

a first leg connected to the first leg assembly;

a second leg connected to the first leg assembly;

a cross member connected to the table top, the cross member extending across at least a portion of a width of the table top;

a support brace connected to the first and second legs and the cross member; and a retaining member connected to the cross member, the retaining member being separate and distinct from the table top, the retaining member being sized and configured to releasably receive and retain a portion of the first leg assembly when the first leg assembly is in the collapsed position.

8. A picnic table comprising:

a table top;

a first bench top;

a second bench top;

a first support member connected to the table top, the first support member being movable between a collapsed position and an extended position relative to the table top;

a second support member connected to the table top, the second support member being movable between a collapsed position and an extended position relative to the table top;

a first support assembly connected to the first bench top, the second bench top, the first support member and the second support member, the first support assembly being movable between a collapsed position and an extended position relative to the table top;

a third support member connected to the table top, the third support member being movable between a collapsed position and an extended position relative to the table top;

a fourth support member connected to the table top, the fourth support member being movable between a collapsed position and an extended position relative to the table top;

a second support assembly connected to the first bench top, the second bench top, the third support member and the fourth support member, the second support assembly being movable between a collapsed position and an extended position relative to the table top;

a first cross member connected to the table top, the first cross member extending across at least a portion of a width of the table top;

a first support brace connected to the first support member, the second support member and the first cross member; and a first retaining member connected to the first cross member, the first retaining member being separate and distinct from the table top, the first retaining member being sized and configured to releasably receive and retain a portion of the first support assembly when the first support assembly is in the collapsed position.

9. The picnic table as in claim 8, wherein the first retaining member includes a passage through which a portion of the first cross member is inserted.

10. The table as in claim 8, further comprising:

a second cross member connected to the table top;

a second support brace connected to the third support member, the fourth support member and the second cross member; and a second retaining member connected to the second cross member, the second retaining member being sized and configured to releasably receive and retain a portion of the second support assembly when the second support assembly is in the collapsed position.

11. The picnic table as in claim 8, further comprising a first set of protrusions extending from a lower surface of the table top, the first set of protrusions being sized and configured to limit movement of the first retaining member relative to the first cross member.

12. The table as in claim 11, wherein the first set of protrusions are integrally formed in the table top as part of unitary, one-piece structure during a molding process.

13. The table as in claim 11, wherein each of the first set of protrusions includes a hollow interior portion.

14. A table comprising:

a table top;

a first leg assembly connected to the table top, the first leg assembly movable between a collapsed position and an extended position;

a first cross member connected to the table top, the first cross member extending across at least a portion of a width of the table top;

a first support brace connected to the first leg assembly and the first cross member, the first support brace being movable between a collapsed position and an extended position;

a first protrusion extending from a lower surface of the table top, the first protrusion including an engagement surface that engages the first support brace to prevent lateral movement of the support brace relative to the first cross member, the first protrusion being integrally formed with the table top as part of a unitary, one-piece structure;

a second protrusion extending from the lower surface of the table top, the second protrusion including an engagement surface that engages the first support brace to prevent lateral movement of the support brace relative to the first cross member, the second protrusion being integrally formed with the table top as part of a unitary, one-piece structure; and a first retaining member connected to the first cross member, the first retaining member being separate and distinct from the table top, the first retaining member being sized and configured to releasably receive and retain a portion of the first leg assembly when the first leg assembly is in the collapsed position.

15. The table as in claim 14, wherein the engagement surface of the first protrusion contacts and abuts a first portion of the first support brace while the engagement surface of the second protrusion contacts and abuts a second portion of the first support brace to prevent lateral movement of the support brace relative to the first cross member.

16. The table as in claim 14, wherein the first retaining member includes a passage through which a portion of the first cross member is inserted.

17. The table as in claim 14, further comprising:

a first bench connected to the first leg assembly;

a second bench connected to the first leg assembly;

a first support connected to the first bench, the first support being sized and configured to limit movement of the first leg assembly when the first leg assembly is in the extended position; and a second support connected to the second bench, the second support being sized and configured to limit movement of the second leg assembly when the second leg assembly is in the extended position.

18. The table as in claim 14, wherein the engagement surface of the first protrusion contacts and abuts a first portion of the first support brace while the engagement surface of the second protrusion contacts and abuts a second portion of the first support brace to prevent lateral movement of the support brace relative to the first cross member.

19. The table as in claim 14, wherein the first protrusion and the second protrusion are integrally formed in the table top as part of unitary, one-piece structure during a molding process.

20. The table as in claim 14, wherein the first protrusion and the second protrusion includes a hollow interior portion that is formed during a molding process.

21. The table as in claim 14, further comprising:

a second leg assembly connected to the table top, the second leg assembly movable between a collapsed position and an extended position;

a second cross member connected to the table top;

a second support brace connected to the second leg assembly and the second cross member, the second support brace being movable between a collapsed position and an extended position; and a second retaining member connected to the second cross member, the second retaining member being sized and configured to releasably receive and retain a portion of the second leg assembly when the second leg assembly is in the collapsed position.

* * * * *

UNITED STATES PATENT AND TRADEMARK OFFICE

CERTIFICATE OF CORRECTION

PATENT NO. : 7,735,915 B2
APPLICATION NO. : 11/329013
DATED : June 15, 2010
INVENTOR(S) : Nye et al.

It is certified that error appears in the above-identified patent and that said Letters Patent is hereby corrected as shown below:

Column 6
Line 21, change "appreciated" to --appreciate--

Column 9
Line 10, change "recessed portion" to --recessed portion 126--

Column 14
Line 40, change "part of unitary" to --part of the unitary--
Line 43, change "includes" to --include--

Signed and Sealed this

Seventh Day of December, 2010

David J. Kappos

David J. Kappos
*Director of the United States Patent and Trademark Office*